US011489267B1

(12) United States Patent
Siemsen et al.

(10) Patent No.: US 11,489,267 B1
(45) Date of Patent: Nov. 1, 2022

(54) CYLINDRICAL CONTINUOUS-SLOT ANTENNA MADE FROM DISCRETE WRAP-AROUND ANTENNA ELEMENTS

(71) Applicant: Southwest Research Institute, San Antonio, TX (US)

(72) Inventors: Patrick Siemsen, Boerne, TX (US); Ralph Riojas, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 5 days.

(21) Appl. No.: 17/341,067

(22) Filed: Jun. 7, 2021

(51) Int. Cl.

| | |
|---|---|
| ***H01Q 21/00*** | (2006.01) |
| ***H01Q 17/00*** | (2006.01) |
| ***H01Q 21/06*** | (2006.01) |
| ***H01Q 1/12*** | (2006.01) |
| ***H01Q 1/38*** | (2006.01) |

(52) U.S. Cl.
CPC ..... *H01Q 21/0025* (2013.01); *H01Q 1/1242* (2013.01); *H01Q 1/38* (2013.01); *H01Q 17/008* (2013.01); *H01Q 21/0087* (2013.01); *H01Q 21/064* (2013.01)

(58) Field of Classification Search
CPC ..... H01Q 21/00; H01Q 1/12; H01Q 1/38; H01Q 17/00; H01Q 21/06
See application file for complete search history.

(56) References Cited

U.S. PATENT DOCUMENTS

| | | | | |
|---|---|---|---|---|
| 2004/0021611 | A1* | 2/2004 | Iida | H01Q 21/0087 343/770 |
| 2005/0088353 | A1* | 4/2005 | Irion, II | H01Q 13/085 343/768 |
| 2009/0121967 | A1* | 5/2009 | Cunningham | H01Q 13/085 343/908 |

* cited by examiner

*Primary Examiner* — Andrea Lindgren Baltzell
(74) *Attorney, Agent, or Firm* — Livingston Law Firm

(57) ABSTRACT

An omnidirectional vertically polarized antenna. A number of antenna elements are each fabricated on a backing, such as a printed circuit board. The front of each antenna element has conductive strips and slots, arranged in an alternating pattern. The back of each antenna element has an antenna feed circuit. An electrically absorptive layer is attached to the back of each antenna element. The antenna elements are assembled together in a nonconductive housing with circumferentially arranged compartments that receive the antenna elements.

17 Claims, 8 Drawing Sheets

CYLINDRICAL CONTINUOUS-SLOT ANTENNA MADE FROM DISCRETE WRAP-AROUND ANTENNA ELEMENTS

TECHNICAL FIELD OF THE INVENTION

This patent application relates to antennas, and more particularly to cylindrical continuous-slot antennas.

BACKGROUND OF THE INVENTION

For traditional high frequency (>1 GHz) direction finding (DF) antenna arrays that must be mounted around a vertical mast, the challenge is to position the array elements close enough to each other (within an electrical half-wavelength center to center) so that DF sidelobes are minimized and a beamformed omnidirectional output for acquisition and reference processing can be formed. If the array elements are positioned too far apart from each other, DF sidelobe levels increase and a suitable omnidirectional output cannot be formed. For lower frequency arrays, this is not an issue as the electrical wavelength is much larger than the antenna elements themselves (the electrical wavelength is inversely proportional to frequency). For higher frequency arrays, the physical size of traditional antenna elements is much larger than an electrical wavelength such that they cannot be spaced within an electrical half-wavelength center to center.

Cylindrical continuous-slot antenna arrays provide a viable solution to this problem. A cylindrical continuous-slot antenna consists of a (theoretically infinite) number of vertically stacked conductive ringed strips, separated from one another creating radiating slots in between. The strips wrap around themselves creating slots that are continuous in the circumferential dimension. Equally spaced feed points are placed across the slots at no greater than half-wavelength spacing (at the highest operating frequency) around the circumference. If equally combined, the resultant radiation pattern will be omnidirectional in azimuth and vertically polarized.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a cylindrical continuous-slot antenna array. The "cylindrical" aspect of the antenna array is achieved by assembling a number of discrete antenna "faces" in a closed shape, such as an octagon. Each face is formed on printed circuit board material and has an outer surface with conductive strips and slots and an inside surface with antenna feeds. The faces are thus discrete elements but are assembled in a side-by side manner to form the entire antenna array.

The antenna array is suitable for various signal acquisition applications. It is particularly suitable for use with direction finding (DF), where the antenna receives signals from an unknown transmitter, and its output is used to determine an angle of arrival of the unknown signal.

The antenna may be generally described as an omnidirectional vertically polarized receive antenna, that is, it receives equally well in 360 degrees of azimuth toward the horizon. It may be easily mounted around a mast to provide full 360-degree coverage.

Figure 1:
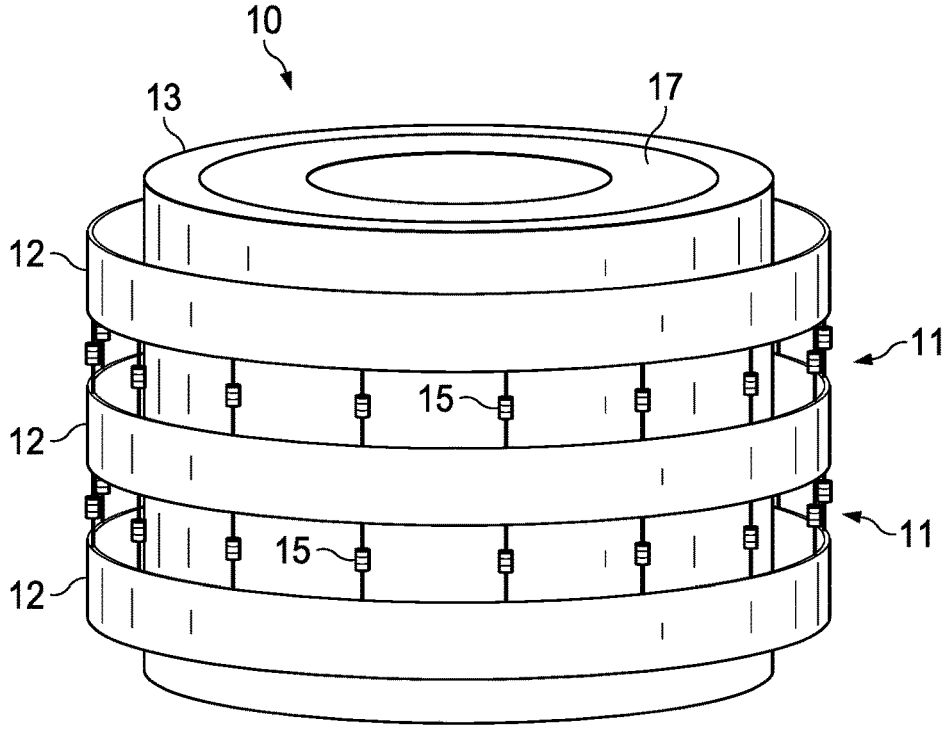
FIG. 1 (PRIOR ART)
FIG. 1 illustrates a theoretical cylindrical continuous-slot antenna.

FIG. 1 illustrates a theoretical cylindrical continuous-slot antenna 10. The view of FIG. 1 is an exploded and representative view, showing an antenna having only two slots 11. A mast 17 is shown going through the center of the antenna 10.

Slots 11 are between conducting strips 12 that are circumferentially continuous. The strips 12 are backed by a layer 13 of electrically absorbing material.

Equally spaced feed points 15 are placed across the slots 11 at no greater than half-wavelength spacing (at the highest frequency) around the antenna array. If equally combined, the resultant radiation pattern will be omnidirectional in azimuth and vertically polarized.

The slots 11 are bi-directional, meaning they receive both radially out and in from center. The inward portion must be absorbed to prevent undesired interference, hence the presence of absorbing layer 13.

As recognized by the present invention, the challenge in any practical implementation of a cylindrical continuous-slot antenna array is to reduce the number of slots and feed points from an infinite number to a finite number while maintaining the desired performance.

Figure 2:
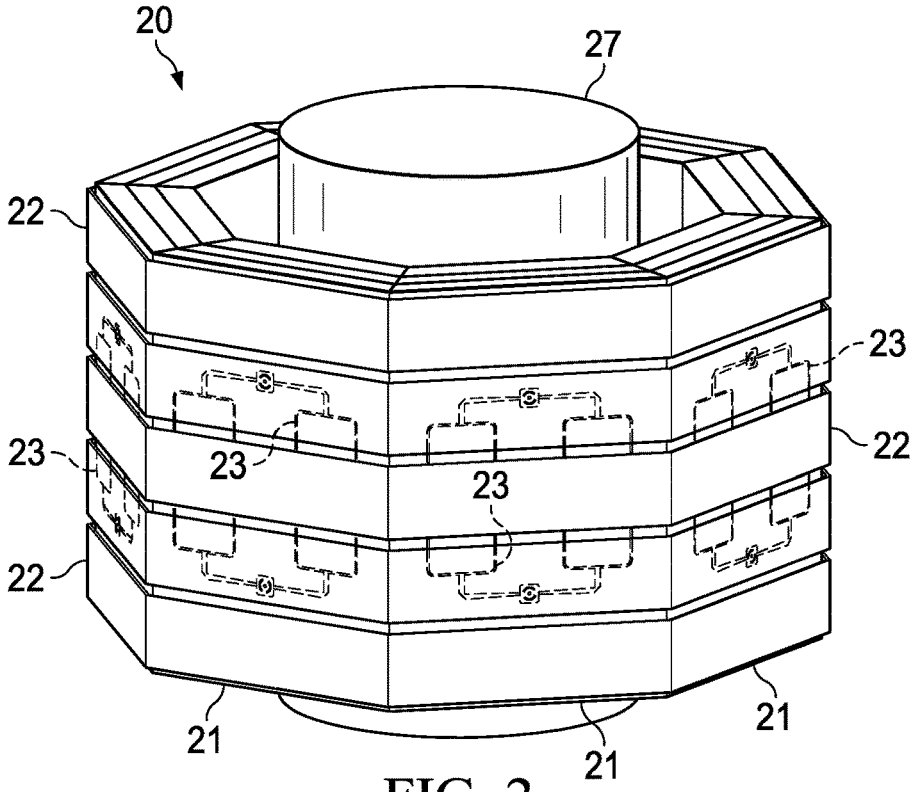
FIG. 2 illustrates a cylindrical continuous-slot antenna array in accordance with the invention.

FIG. 2 illustrates a cylindrical continuous-slot antenna 20 in accordance with the invention. Antenna 20 is shown mounted around a mast 27. For practical installation applications, antenna 20 can wrap around or be integrated with the mast.

The antenna 20 is divided into eight flat faces 21, giving it an octagonal shape instead of a "true" cylindrical shape. Each face 21 serves as an individual antenna element, thus antenna 20 is an array of eight antenna elements. In other embodiments, a different number of faces could be used to provide a different number of array elements. Although not explicitly shown in FIG. 2, the faces 21 may be contained in a housing such as that described below in connection with FIG. 7.

Each face 21 is formed using a printed circuit board material or similar material. Strips of conductive material 22 are attached to the front of each face, and antenna feeds 23 are printed onto the back of each face. Thus, the view of FIG. 2 is a transparent view in the sense that antenna feeds 23 are shown. However, these feeds are actually located on the back of the faces 21.

In the embodiment of this description, each face 21 has five strips of conductive material 22 with slots between. Other numbers of strips could be used. When antenna 20 is assembled as in FIG. 2, the strips 22 and slots of the faces 21 align around the circumference of the antenna 20.

In the example of FIG. 2, each face 21 is 4 inches in width. The overall diameter of the antenna array 20 is approximately 10.2 inches. It expected that antenna 20 will be suitable for operation from about 1 GHz to at least 6 GHz. However, antenna 20 may be electrically scaled for any frequency range.

Antenna feeds 23 are placed around the circumference of the antenna 20. In this example, feeds 23 are placed across the middle two slots only at one inch spacing (corresponding to a half-wavelength at 6 GHz), for a total of 4×2=8 feeds per face. The outer feeds are spaced one-half inch from the edges of the face 21 so that when the faces 21 are placed assembled to create antenna 20, the one inch spacing is maintained between feeds across faces. In total there are 64 feeds in the entire antenna 20. In other embodiments, other numbers of feeds could be used, typically an even number oppositely fed.

Figure 4:
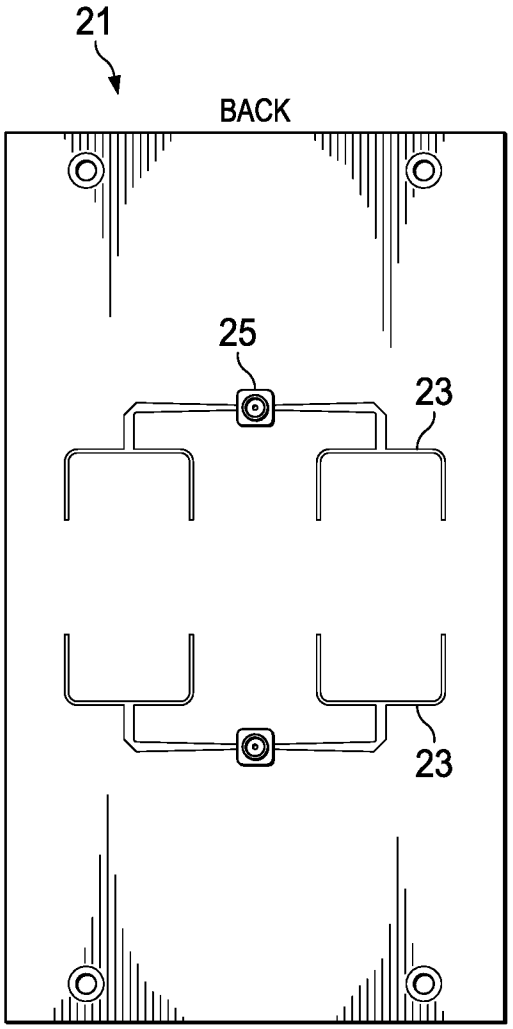
FIGS. 3 and 4 are a front plan view and back plan view, respectively, of one antenna element, which comprises a face of the assembled antenna.
Figure 3:
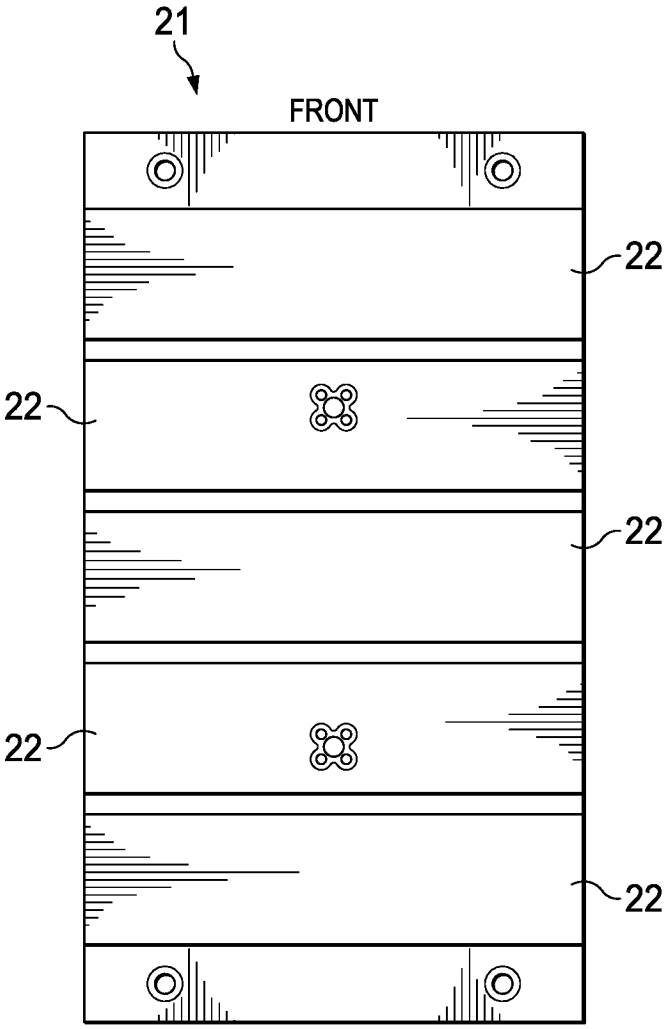

FIGS. 3 and 4 illustrate one face (antenna element) 21 of the antenna 20. FIG. 3 illustrates the front of one face 21 showing the conductive strips. FIG. 4 illustrates the back of face 21 having a circuit for providing and connecting antenna feeds 23.

The printed circuit board that provides the base material for each face 21 has conductive strips attached to its front surface and an antenna feed microstrip circuit printed on its back surface. In the embodiment of FIGS. 3 and 4, the front of each face 21 has five conductive strips 22 with four slots between these strips.

The antenna feed circuit may be a "printed circuit" using printed circuit board fabrication techniques or may be otherwise attached to or fabricated upon a substrate/backing. The printed circuit board may equivalently be any sort of non-conductive substrate material that is suitable for attaching slots on the front and an antenna feed circuit on the back.

In the example of this description, each circuit board (or other substrate material) is planar and the faces 21 are flat. However, curved circuit boards are also possible to provide a truly cylindrical shape of antenna 20. A flexible material could be used for this purpose.

The slot and strip widths may be numerically modeled to determine the proper dimensions to obtain a 100 Ohm impedance at each feed point across the intended operating frequency range. The top and bottom unfed slots are present to help maintain the impedance over a wider frequency range.

An example of a suitable thickness of the printed circuit board or other base material is 0.032 inches. An example of a suitable material is Rogers DiClad880 material.

The middle two slots are oppositely connected. The feeds 23 are connected via microstrip lines on the back side of the circuit board to two RF outputs 25, one for the upper slot and one for the lower slot. The microstrip lines transition from 100 Ohms at the feed points to 50 ohms at their RF outputs 25.

Figure 5:
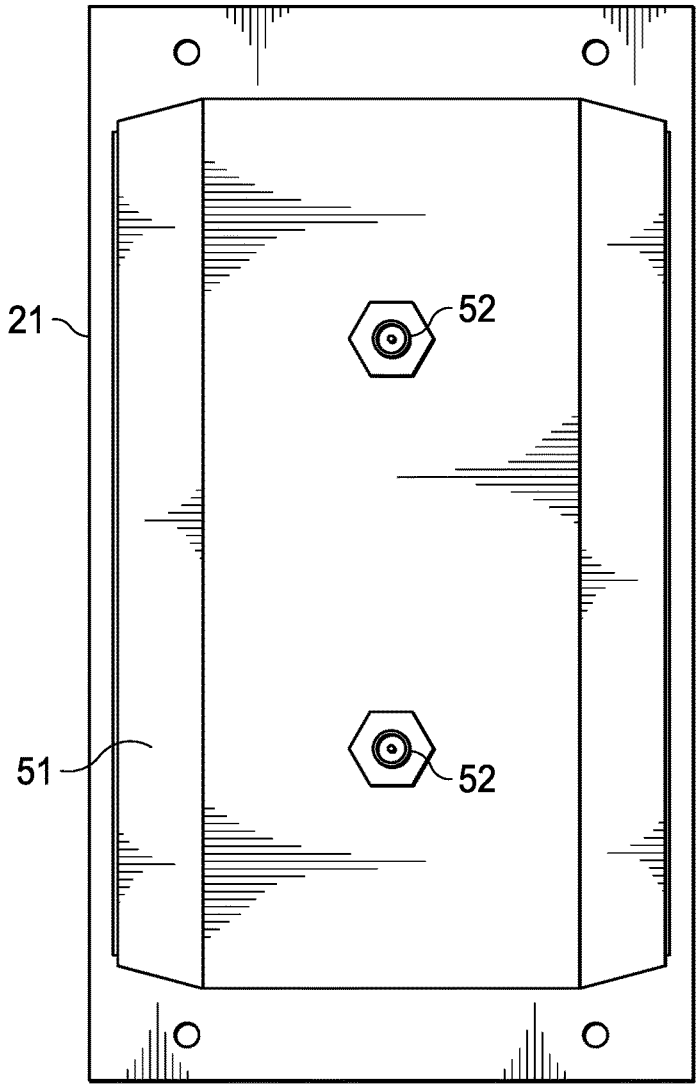
FIGS. 5 and 6 illustrate a rear view and side view, respectively, of a single antenna element (face) and its electrically absorptive backing layer.
Figure 6:
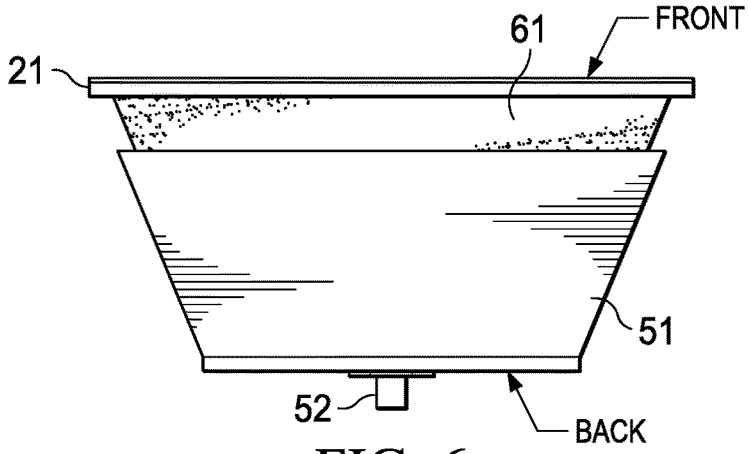

FIGS. 5 and 6 illustrate a rear view and side view, respectively, of a single antenna element (face) 21 and its electrically absorptive backing 51. The absorptive backing may be a conductive foam or ferrite material. In the embodiment of FIGS. 5 and 6, a thin sheet of packaging foam 61 separates the absorptive foam 51 from the antenna face 21.

Electrical connectors 52 allow connectors 23 on the back of the face 21 to be electrically connected externally. Short phase-matched semi-rigid RF cables (not shown) extend from the connectors 23 through the absorptive material 51.

Figure 7:
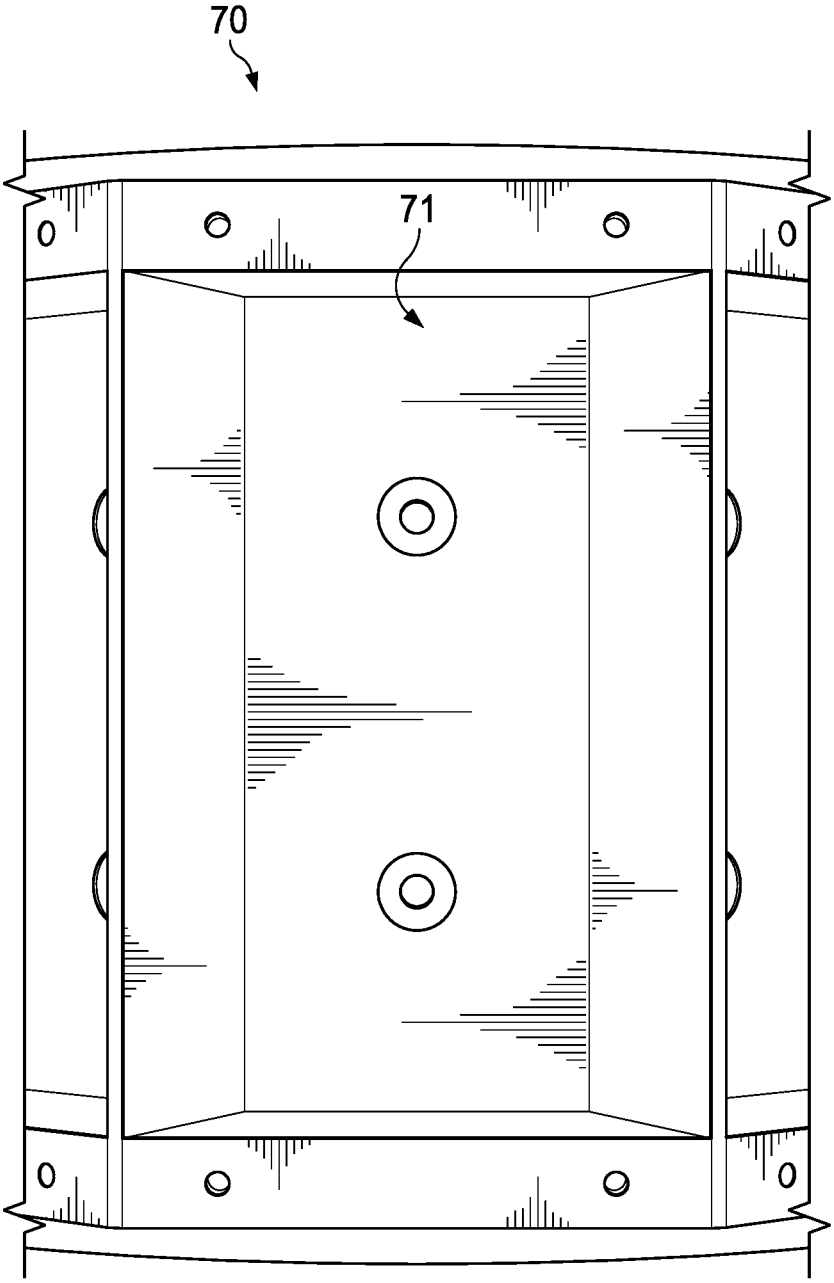
FIG. 7 illustrates a housing having eight compartments into which the antenna elements are installed.

FIG. 7 illustrates a housing 70, which is a faceted ring of eight compartments 71. Each compartment 71 is a cavity that is shaped to conformally receive one of the antenna elements (faces) and its absorptive backing. As explained above, each face 21 comprises a base material with conductive strips on its front side and antenna feeds on its back side.

Housing 70 typically has an inner opening that is generally cylindrical or otherwise conforming to the mast upon which antenna 20 is to be mounted. However, antenna 20 could also be mounted atop a mast or other support, without need for an inner opening of housing 70.

The outer surface takes upon the polygon shape of the assembled antenna elements, that is, for an antenna having eight antenna elements, the outer shape of housing 70 is octagonal and the assembled antenna 20 takes on the same shape.

Housing 70 is made from a plastic or other nonconductive material. A suitable material is an ABS (Acrylonitrile Butadiene Styrene) plastic. The housing may comprise an assembled wrap-around ring of separate compartments, or it may be a single integrated piece, or multiple pieces with multiple compartments.

At the back of each compartment 71 is a metallic backing. Two holes receive the connectors 51 so that external connections to the antenna may be made.

Figure 8:
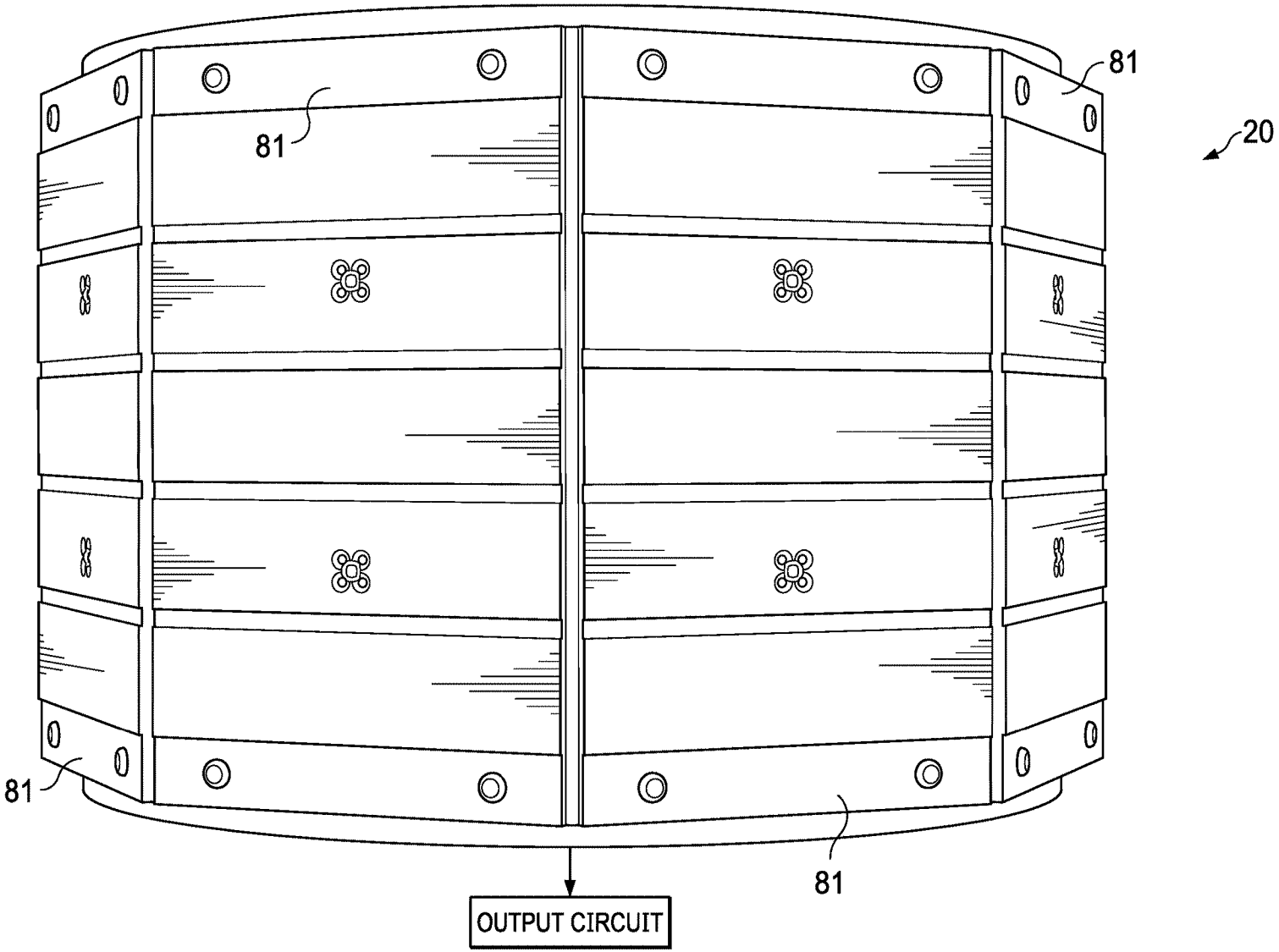
FIG. 8 illustrates an example of an assembled antenna, with antenna elements installed into their respective compartments of the antenna housing.

FIG. 8 illustrates an example of an assembled antenna 20, with antenna elements (faces 21) installed into their respective compartments of housing 70. Where antenna 20 has eight antenna elements, four of the eight faces 21 are in view.

The faces 21 may be held together onto housing 70 with metal plates 81 top and bottom. Typically, housing 70 is assembled by assembling its separate compartments into a faceted ring (before or after inserting the antenna elements into the compartments. This allows the antenna to be easily attached around a mast. However, where the antenna is not to be used around a mast, housing 17 could be fabricated as a single piece.

For the assembled antenna 20, the conductive strips across faces 21 are aligned circumferentially but need not have additional electrical connection. In other words, the faces 21 may be adjacent but need not be physically connected. The faces 21 are placed close enough to not impact antenna performance as compared to the continuous strips of a conventional cylindrical continuous-slot antenna. This simplifies the design and assembly of antenna 20 and allows for easy installation and removal of each face 21 individually.

The antenna feeds are delivered to whatever receiver, controller, or other output circuitry 82 that is appropriate for the application.

Figure 9:
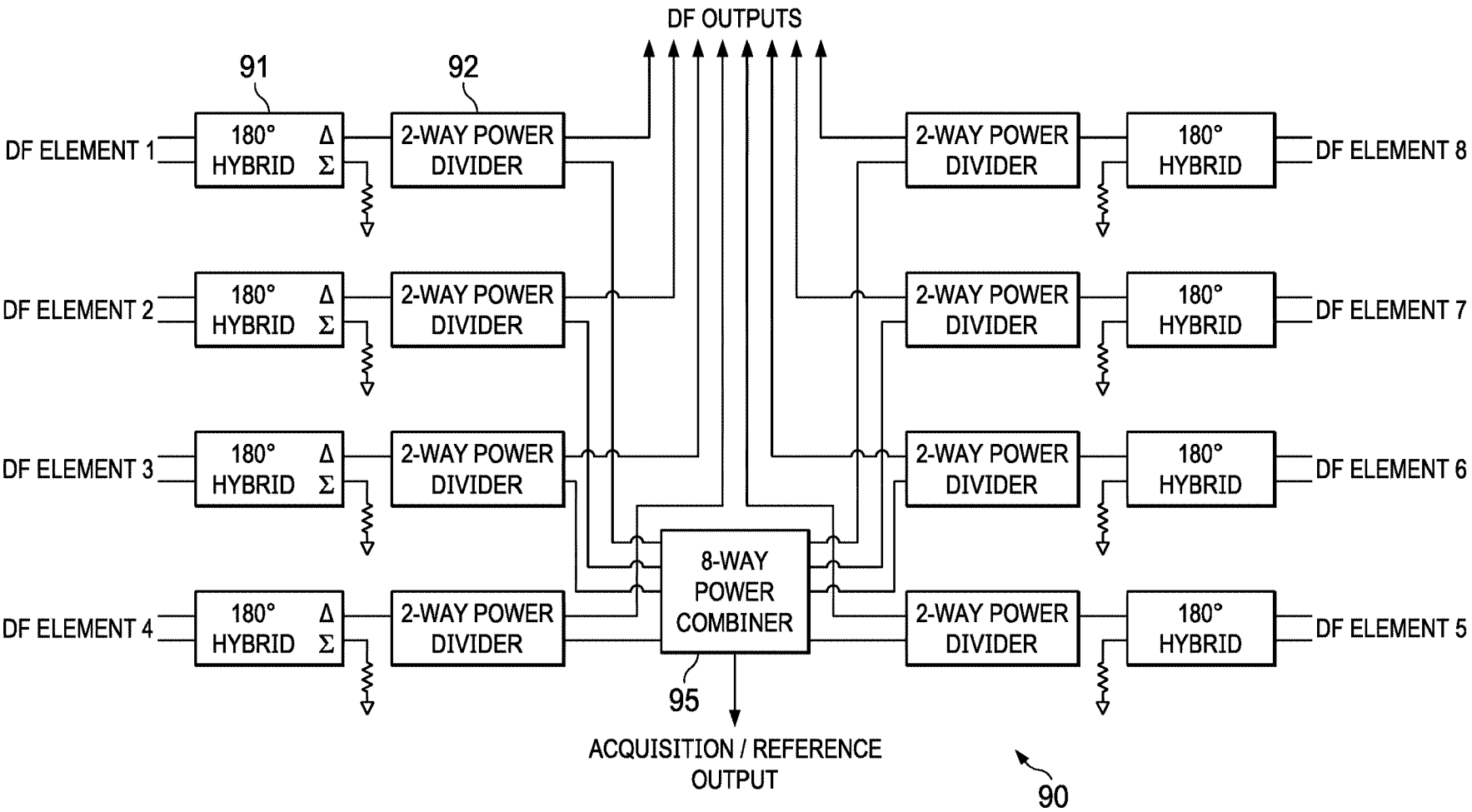
FIG. 9 illustrates an example of output circuitry for the antenna.

FIG. 9 illustrates an example of output circuitry for antenna 20, in the form of a combiner network 90. Network 90 is especially designed to provide both acquisition/reference and DF outputs for DF applications.

Because the middle slots of each face 21 (antenna element) are oppositely fed, the two RF outputs from each antenna element connect into the sum and difference ports of 180° hybrid couplers 91 producing the final DF outputs. These outputs are then fed into 2-way power dividers 92 to create two versions, one for the DF outputs and the others to be summed together via an 8-way power divider 95 to form an acquisition/reference output. All RF cables connecting from the antenna elements to the hybrid couplers 91 and from the hybrid couplers to the power dividers 92 are phase matched.

Figure 10:
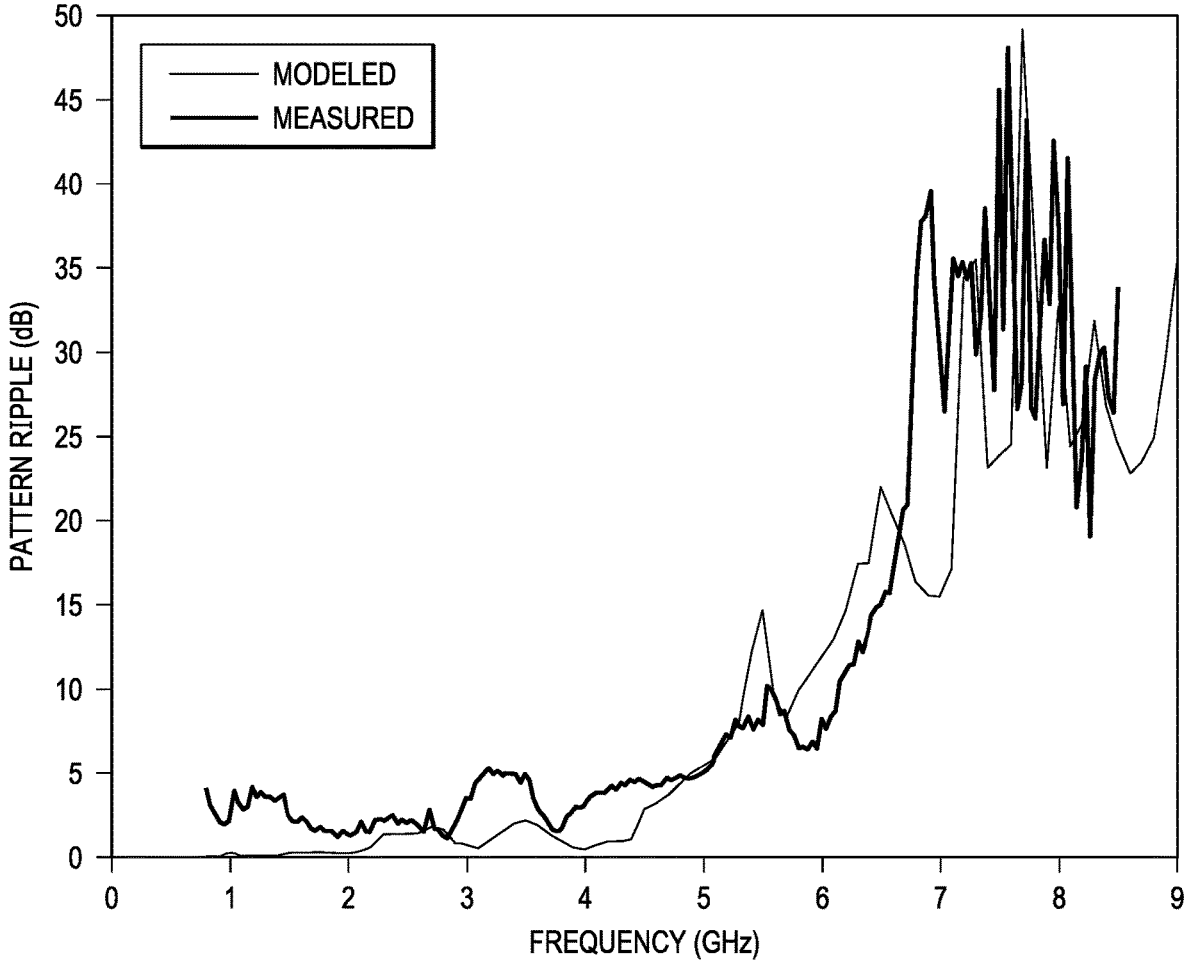
FIG. 10 illustrates an example of results of experimental testing of performance of antenna.

FIG. 10 illustrates an example of results of experimental testing of performance of antenna 20, including DF outputs. The antenna patterns of the acquisition/reference and DF outputs were measured in an anechoic chamber. The measured ripple, in the acquisition/reference output, as a function of frequency, is shown. This ripple was less than 5 dB below 5 GHz but slowly increased above that. The ripple measured below 6 GHz is attributed to variances and tolerances in the printed circuit boards and RF cables, and the octagon instead of cylindrical shape of the array. Above 6 GHz, the ripple increases, as expected, as the spacing of the feed points now exceeds one-half wavelength (the array was not designed for operation above 6 GHz).

In one experiment, the conductive strips across the faces 21 were connected using metal tape with no measurable reduction in the pattern ripple. This validates the numerically modeled results predicted.

Figure 11:
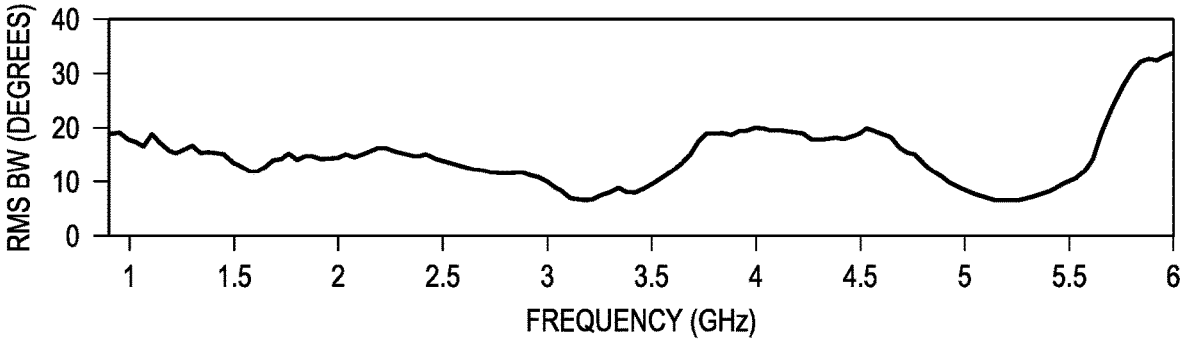
FIGS. 11-13 illustrate estimates of the direction finding (DF) performance of the antenna.
Figure 12:
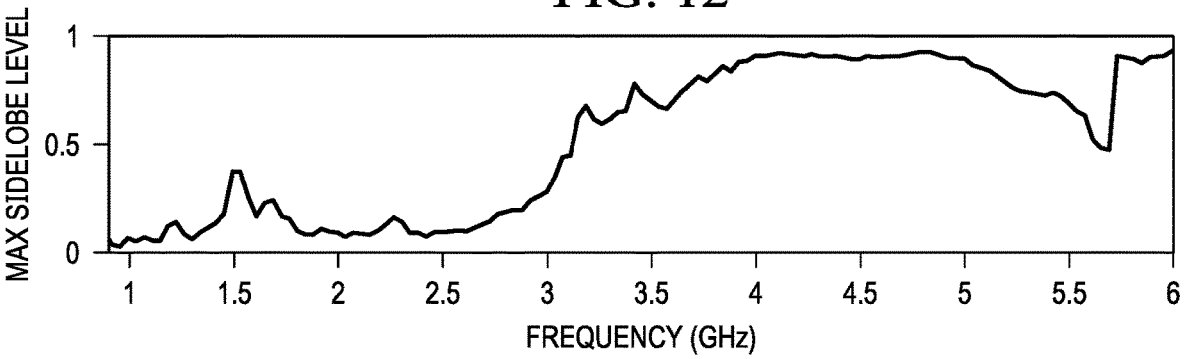
Figure 13:
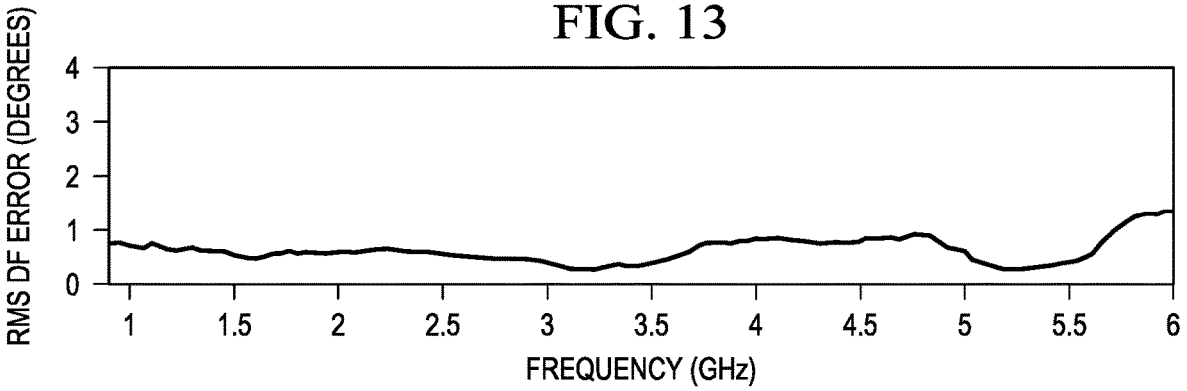

FIGS. 11-13 illustrate estimates of the DF performance of antenna 20. The DF characteristics were analyzed using a correlation type DF algorithm. This DF analysis and the acquisition/reference results above indicate that this array functions very well up to 6 GHz.

FIG. 11 illustrates the RMS beamwidth, which is the width of the main beam of the DF correlation pattern inside the DF algorithm. This value can vary anywhere from 0 to 360 degrees. The beamwidth is inversely proportional to the antenna aperture. A lower beamwidth, and hence a wider aperture, is desirable as this results in better immunity from noise induced DF error. For antenna array 20, the beamwidth is well behaved and stays below 40 degrees, indicating sufficient aperture.

FIG. 12 illustrates the maximum sidelobe, which is a measure of the peak correlation outside the main beam and can range in value from 0 to 1. When the maximum sidelobe is too high, generally above 0.8, large DF errors can result when there are significant error sources. In this case the maximum sidelobe exceeds the 0.8 threshold starting just below 4.5 GHz.

FIG. 13 is a DF error plot and illustrates that the location of those side-lobes is near the main beam where the DF error remains less than 2 degrees for a 10 dB SNR using 10 DF samples. This represents a worst-case condition for analysis purposes.

What is claimed is:

1. An omnidirectional vertically polarized antenna, comprising:

a number of antenna elements, each antenna element fabricated on a backing, and having conductive strips and slots, arranged in an alternating pattern, on a front side of the backing and an antenna feed circuit on the back side of the backing;

an electrically absorptive layer attached to the back of each antenna element;

a nonconductive housing comprising circumferentially arranged compartments;

wherein each compartment conforms to the size and shape of one antenna elements and its associated absorptive layer, such that an antenna element and its associated backing are inserted into each compartment.

2. The antenna of claim 1, wherein the antenna is to be mounted around a mast and the housing has an inner opening that allows the mast to be positioned inside the housing.

3. The antenna of claim 1, wherein each antenna element is planar, such that the antenna has a polygon shaped outer surface.

4. The antenna of claim 1, wherein each antenna element is curved, such that the antenna has a cylindrically shaped outer surface.

5. The antenna of claim 1, wherein the backing is printed circuit board material and the antenna feeds comprise printed circuitry.

6. The antenna of claim 1, wherein the antenna feed circuit is configured with antenna feeds across two or more of the slots.

7. The antenna of claim 6, wherein the antenna feeds are across the middle slots and are oppositely fed.

8. The antenna of claim 6, wherein the top and bottom slots have no antenna feeds.

9. The antenna of claim 1, wherein the conductive strips of each antenna element are aligned circumferentially but without additional electrical connection between them.

10. The antenna of claim 1, further comprising an antenna output circuit that receives input from the antenna feeds and generates direction finding outputs.

11. The antenna of claim 1, further comprising an antenna output circuit that receives input from the antenna feeds and generates reference/acquisition outputs.

12. The antenna of claim 1, wherein the nonconductive housing is assembled from two or more groups of compartments attached together.

13. The antenna of claim 1, wherein the nonconductive housing is assembled from separate compartments attached together.

14. A method of assembling an omnidirectional vertically polarized antenna, comprising:

manufacturing a number of antenna elements, each antenna element fabricated on a backing, and having conductive strips and slots, arranged in an alternating pattern, on a front side of the backing and an antenna feed circuit on the back side of the backing;

attaching an electrically absorptive layer to the back of each antenna element;

manufacturing a nonconductive housing comprising circumferentially arranged compartments, wherein each compartment conforms to the size and shape of one antenna elements and its associated absorptive layer; and inserting an antenna element and its associated absorptive layers into each compartment.

15. The method of claim 14, wherein the nonconductive housing is assembled from two or more groups of compartments attached around a mast prior to being attached together.

16. The method of claim 14, wherein the nonconductive housing is assembled from separate compartments attached around a mast prior to being attached together.

17. The method of claim 14, wherein the backing is printed circuit board material and the antenna feeds comprise printed circuitry.

* * * * *